US005621366A

United States Patent [19]

Gu et al.

[11] Patent Number: 5,621,366

[45] Date of Patent: Apr. 15, 1997

[54] HIGH-Q MULTI-LAYER CERAMIC RF TRANSMISSION LINE RESONATOR

[75] Inventors: Wang-Chang A. Gu, Coral Springs, Fla.; Richard S. Kommrusch, Albuquerque, N.M.

[73] Assignee: Motorola, Inc., Schaumburg, Ill.

[21] Appl. No.: 620,630

[22] Filed: Mar. 22, 1996

Related U.S. Application Data

[63] Continuation-in-part of Ser. No. 290,576, Aug. 15, 1994, abandoned.

[51] Int. Cl.[6] ..... H01P 1/20

[52] U.S. Cl. ..... 333/204; 333/185; 333/219

[58] Field of Search ..... 333/202, 204–205, 333/219, 185

[56] References Cited

U.S. PATENT DOCUMENTS

| | | | |
|---|---|---|---|
| 4,578,654 | 3/1986 | Tait | 333/175 |
| 4,701,727 | 10/1987 | Wong | 333/204 |
| 4,904,967 | 2/1990 | Morii et al. | 333/185 |
| 4,916,417 | 4/1990 | Ishikawa et al. | 333/204 |
| 4,992,759 | 2/1991 | Giraudeau et al. | 333/204 |
| 5,237,296 | 8/1993 | Mandai et al. | 333/204 |
| 5,382,925 | 1/1995 | Hayashi et al. | 333/112 |
| 5,392,019 | 2/1995 | Ohkubo | 333/185 |
| 5,404,118 | 4/1995 | Okamura et al. | 333/185 |
| 5,406,235 | 4/1995 | Hayashi | 333/204 |
| 5,408,206 | 4/1995 | Turunen et al. | 333/204 |
| 5,446,430 | 8/1995 | Yamanaka et al. | 333/202 |
| 5,530,411 | 6/1996 | Nakata et al. | 333/185 |

FOREIGN PATENT DOCUMENTS

| | | | |
|---|---|---|---|
| 4-43703 | 2/1992 | Japan . | |
| 4-58601 | 2/1992 | Japan | 333/204 |
| 5-218705 | 8/1993 | Japan | 333/204 |
| 5-267907 | 10/1993 | Japan . | |
| 5-299912 | 11/1993 | Japan . | |
| 5-335866 | 12/1993 | Japan | 333/185 |
| 6-97705 | 4/1994 | Japan | 333/204 |

*Primary Examiner*—Robert Pascal
*Assistant Examiner*—Darius Gambino
*Attorney, Agent, or Firm*—Frank M. Scutch, III

[57] ABSTRACT

A high Q multi-layer ceramic transmission line resonator (100) used for RF applications. The resonator (100) includes a plurality of strips (102) which are separated by a ceramic substrate (104). Each of the strips are interconnected using vias (110) passing through the ceramic substrate (104). The invention utilizes current manufacturing processes to fabricate an equivalent thick center conductor to effectively increase the Q factor. This allows for the resonator to be used in miniature RF communication devices utilized in high tier devices such as voltage controlled oscillators (VCOs) or integrated filter circuits.

9 Claims, 4 Drawing Sheets

HIGH-Q MULTI-LAYER CERAMIC RF TRANSMISSION LINE RESONATOR

CROSS REFERENCE TO RELATED APPLICATIONS

This application is a continuation-in-part of U.S. application Ser. No. 08/290,576, filed Aug. 15, 1994, now abandoned, by Gu, et al., entitled "High Q Multi-Layer Ceramic RF Transmission Line Resonator," and assigned to Motorola, Inc.

TECHNICAL FIELD

This invention relates in general to resonators and more particularly to multi-layer transmission line resonators having a high Q factor.

BACKGROUND

It has been demonstrated that the multi-layer ceramic technologies (MLC) can be used very effectively with RF communication devices. One problem in using this technology is only moderate Q can be obtained for stripline resonators fabricated using current MLC processes. By way of example, FIG. 1 and FIG. 2 show a conventional stripline resonator 10 consisting of dielectric substrates 12 which is metallized on a first side 11 and a second side 13 and includes an embedded center strip conductor 14.

The center conductor may be shaped either in a straight fashion or meandered, zig-zagged or spiraled in a line in the longitudinal direction. If a fixed substrate height and center conductor width are used, the Q of the stripline resonator increases with a corresponding increase in center conductor thickness. This is due to the perimeter of the center conductor cross-section which is enlarged so more conductor area is available to pass RF currents. This initial gain in Q, with increased center conductor thickness, will eventually be canceled due to the reduced dielectric volume, which is the energy storage media for RF signal propagation.

The thickness of the stripline center conductor 14 fabricated using current MLC processes, and/or stripline in general, is usually very thin, i.e. less than 1 mil. One method used to fabricate thick center conductors is the so called "trough-line" approach. This method is shown in FIG. 3 which depicts, a trough 21 carved on a ceramic tape 23. The trough 21 is then filled with a metal paste (not shown). This produces a thick trough line which has been successfully fabricated in the laboratory with encouraging results. One problem associated with the trough line technique is it's difficulty to implement in a mass-production environment. This is due to the shape of the trough 21 extending in the longitudinal direction where it is limited to a few simple shapes to maintain the integrity of the carved ceramic tape.

With the migration of MLC technologies to high tier RF products, many components such as voltage controlled oscillators (VCO) and filters were limited by these low Q factors. It has been determined that the lower Q of the MLC stripline resonators is due to many factors. These include:

1) A low dielectric Q associated with low-fired glass ceramic materials;

2) Impurities added to silver metal paste used for greater adhesion and shrinkage match to ceramic tapes; and 3) Screen printed metal traces which are relatively thin and formed sharp edges after lamination and pressing so metal loss increases due to current bunching at sharp edges and corners sometimes called the proximity effect.

Therefore, to obtain better quality MLC stripline resonator Q, a low-loss, low-fired glass ceramic material, high purity silver metal paste is needed. Further, a means and method is needed to increase metal trace thickness and to alleviate the proximity effect in the stripline structure.

Prior art techniques have relied on thick trough lines in the stripline. These have been successfully fabricated in the laboratory with encouraging results. The present invention provides a simple and cost effective way to fabricate an effective thick MLC stripline resonators by printing two vertically aligned conductor traces which are electrically connected by vias. This results in a 20–30% improvement in resonator Q. Also, the invention does not require new processing techniques and additional fabrication steps and is in compliance with current MLC processing techniques used in the industry. It allows an improvement in MLC stripline resonator Q using MLC technologies allowing production of high-tier RF components.

DETAILED DESCRIPTION OF THE PREFERRED EMBODIMENT

Figure 4:
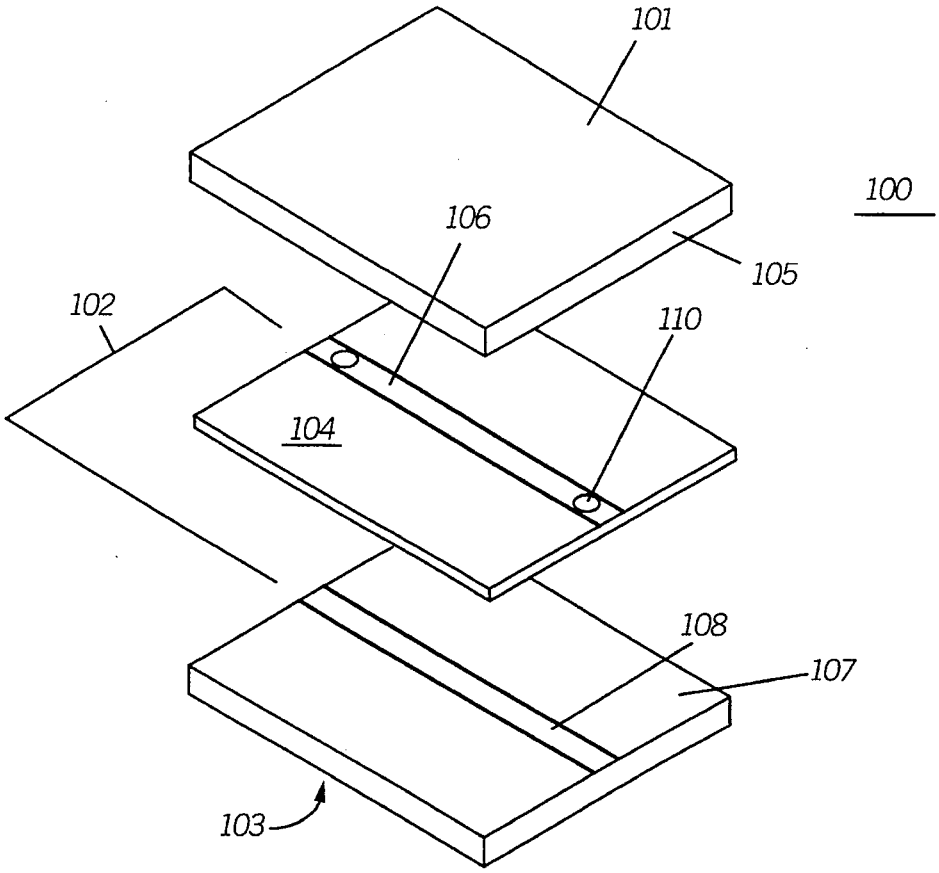
FIG. 4 is an isometric view of the high Q multi-layer ceramic RF transmission line resonator.
Figure 5:
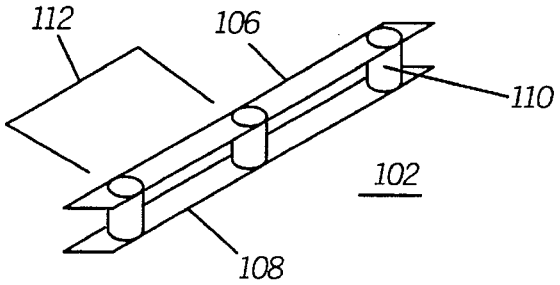
FIG. 5 illustrates two vertically aligned metal traces electrically connected by vias.
Figure 6:
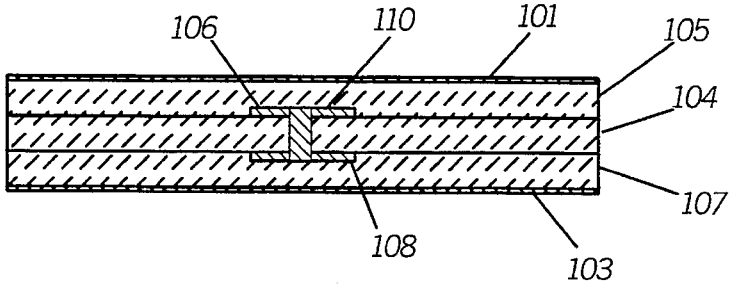
FIG. 6 illustrates a cross sectional view of vertically aligned metal traces separated by ceramic tape as seen in FIGS. 4 and 5.

Referring now to FIGS. 4, 5 and 6, the present invention is shown which provides a simple and inexpensive apparatus and method of fabricating a multi-layer ceramic (MLC) stripline resonator with an effective thick center conductor. The high Q transmission line resonator is generally shown at 100 and is used for carrying or transporting electromagnetic energy between various locations.

The high Q transmission line resonator includes a number of strip conductors such as a first outer conductive layer 101 and second conductive layer 103 which are attached to ceramic substrates 105 and 107 respectively. Conductive layer 101 is the upper outer layer of the device 100 while conductive layer 103 is the lower outer layer. Both the conductive layer 101 and conductive layer 103 act as a ground plane and are preferably made of thick-film silver metallized materials or the like and act to isolate RF energy input to transmission line resonator 100. Between first outer conductive layer 101 and second outer conductive layer 103, a stripline 102 is formed using a section of ceramic tape 104.

The stripline resonator 102 is best seen in FIG. 5 and includes a first metal trace 106 and a second metal trace 108 are separated by at least one portion of the ceramic tape 104. The first metal trace 106 and second metal trace 108 are each connected by a plurality of vias 110 each positioned at a predetermined distance 112. In order suppress higher order mode propagation through the conductive layers 106,108, the vias 110 preferably will be spaced and/or positioned at a distance of at least $\frac{1}{8}l$, where l is the wavelength of the radio frequency (RF) signal propagation through the transmission line resonator 100. This acts to prevent reflections and return loss due to the discontinuities in the conductive layers 106,108, such as bends or changes in planar shape.

Figure 1:
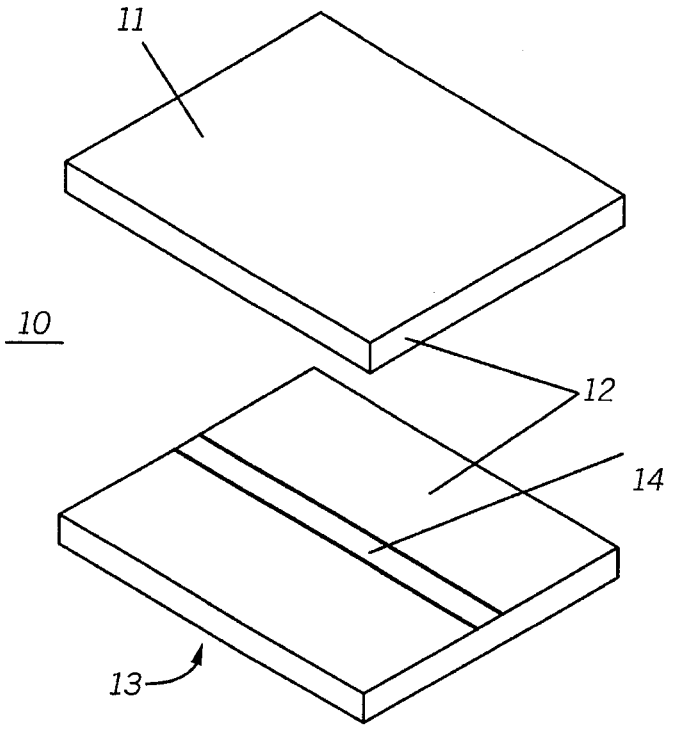
FIG.1 (PRIOR ART)
FIG. 1 is an isometric view of a prior art conventional stripline transmission line resonator.
Figure 2:
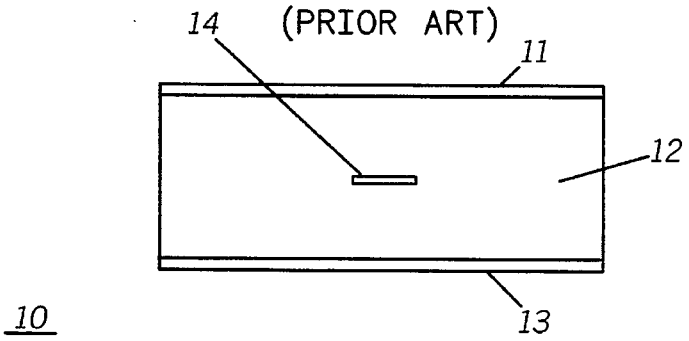
FIG.2 (PRIOR ART)
FIG. 2 is a cross-sectional view of the conventional stripline structure shown in FIG. 1.
Figure 3:
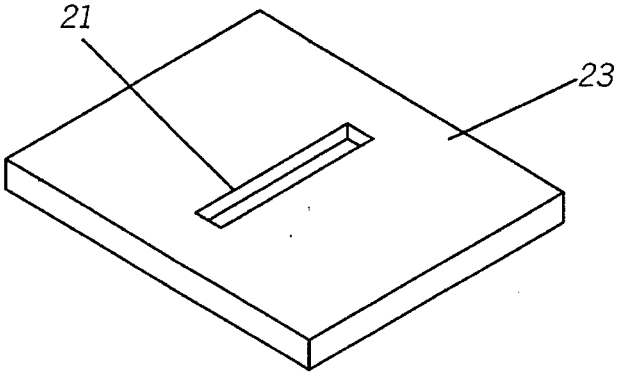
FIG.3 (PRIOR ART)
FIG. 3 is a stripline structure showing a trough carved on a ceramic tape for fabricating an MLC stripline with thick center conductor.

Tests between conventional striplines and the present invention have revealed favorable results. Table 1 below shows the results of SONNET EM numerical simulation of the test geometries as shown between a conventional MLC stripline shown in FIG. 1 and the present invention shown in FIG. 4. Test geometries used in the comparison study were substantially equal at 200 mils×110 mils×40 mils. Substrate dielectric constant was 7.8, loss tangent was 0.002, metal trace width was 10 mils, and separation between first metal trace 106 and second metal trace 108 was 3.7 mils. As seen in Table 1, a 47% gain in Q is predicted by the modeling results.

TABLE 1

| Test Geometry | Characteristic Impedance Ω | Quality Factor @ 1 GHz |
|---|---|---|
| Conventional MLC Stripline | 51.53 | 74.3 |
| MLC Stripline of This Invention | 42.53 | 109.8 |

Table 2 shows the measured quality factors scaled to 1 GHz between the conventional MLC stripline shown in FIG. I and the double layered MLC stripline of the present invention shown in FIG. 4. These resonators were fabricated using the commercially available DuPont GREEN TAPE and DuPont SILVER PASTE 6141. The DuPont GREEN TAPE has a dielectric constant of 7.8, and a loss tangent of 0.002. the sintered silver paste has a thickness of 0.9 mils. The half-wave resonators have similar cross-section and a height of 40 mils. Again, the separation between first metal trace 106 and second metal trace 108 was 3.7 mils.

TABLE 2

| Line Width, mils | Conventional (Q Factor) | The Invention (Q Factor) |
|---|---|---|
| 50 | 92.0 | 110.7 |
| 40 | 91.4 | 108.7 |
| 30 | 84.6 | 102.5 |
| 20 | 78.9 | 101.3 |
| 10 | 69.0 | 88.3 |

Table 3 shows measured quality factors scaled to 1 GHz between the conventional MLC stripline shown in FIG. I and the double layered MLC stripline of the present invention shown in FIG. 4. These resonators were fabricated using commercially available ceramic tape such as that manufactured by Ferro Inc. and a silver paste. (FERROTAPE A6 K=5.9, tan d=0.000667, Metalization thickness was 0.9 mils). These half-wave resonators have similar cross-section and a height of 78 mils. The first metal trace 106 and the second metal trace 108 have a separation of 7.1 mils. As seen in both Tables 1, 2 and 3, a 20–30% increase in Q were observed with the present invention.

TABLE 3

| Line Width, mils | Conventional (Q Factor) | The Invention (Q Factor) |
|---|---|---|
| 50 | 155.4 | 181.5 |
| 40 | 150.2 | 188.1 |
| 30 | 138.2 | 170.7 |
| 20 | 113.5 | 145.1 |
| 10 | 91.7 | 119.1 |

Figure 7:
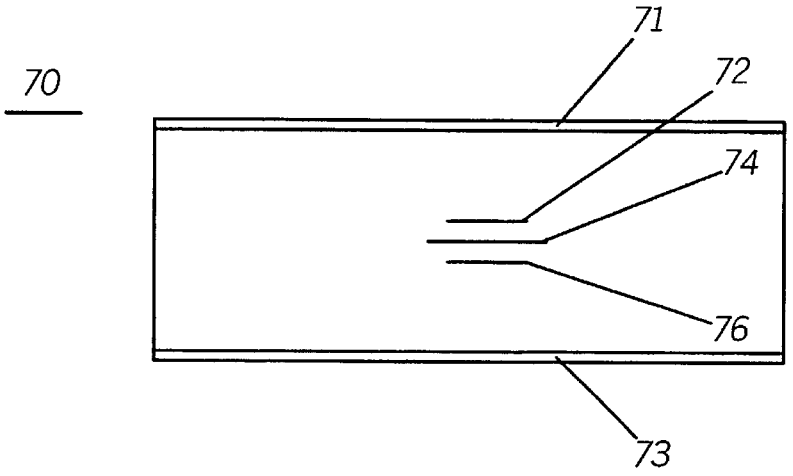
FIG. 7 illustrate an MLC stripline resonator with tri-layered center conductor.
Figure 8:
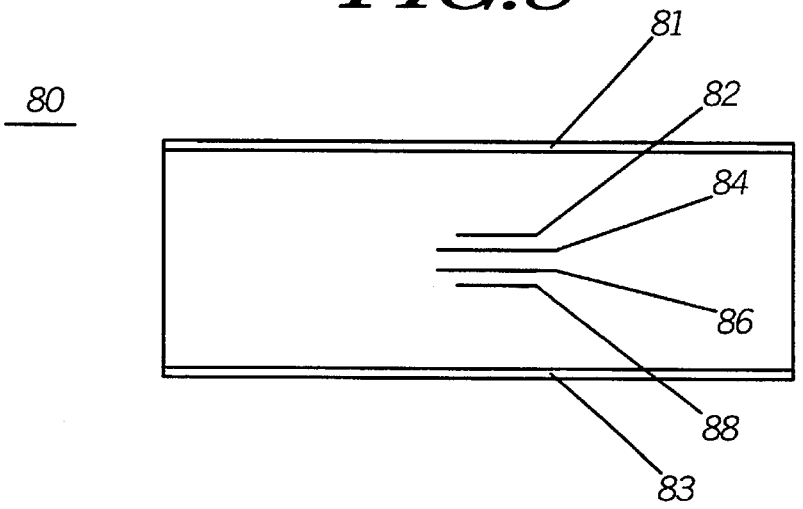
FIG. 8 illustrates an MLC stripline resonator with quadruple center conductor.

FIG. 7 and FIG. 8 are cross-sectional views showing different variations of the present invention. FIG. 7 shows a tri-layer structure 70 which include metal traces 72, 74 and 76 positioned between a first conductive layer 71 and second conductive layer 73. Similarly, FIG. 8 depicts a quadruple structure 80 with metal traces 82, 84, 86, and 88 positioned between first conductive layer 81 and second conductive layer 83.

Figure 9:
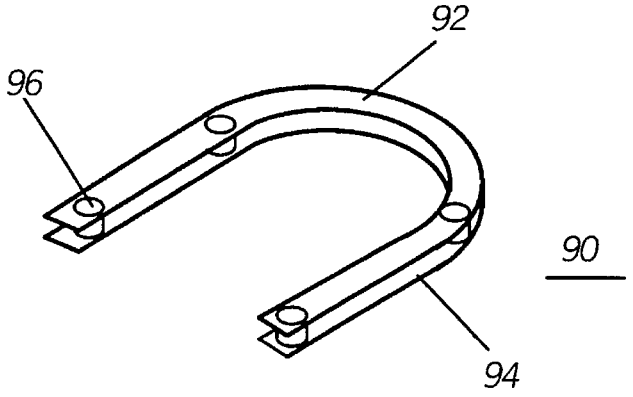
FIGS. 9, 10 and 11 illustrate various implementations of double-layered conductors of an MLC stripline resonators.
Figure 10:
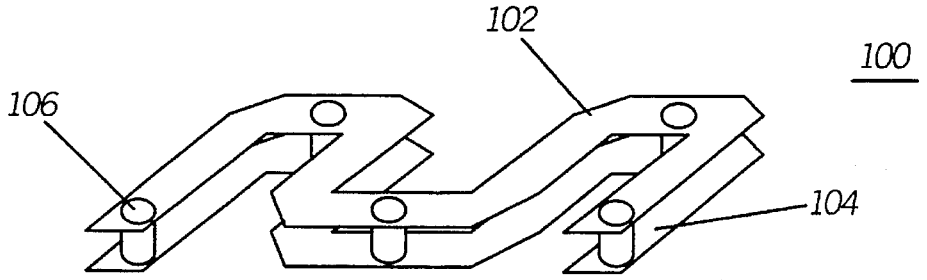
Figure 11:
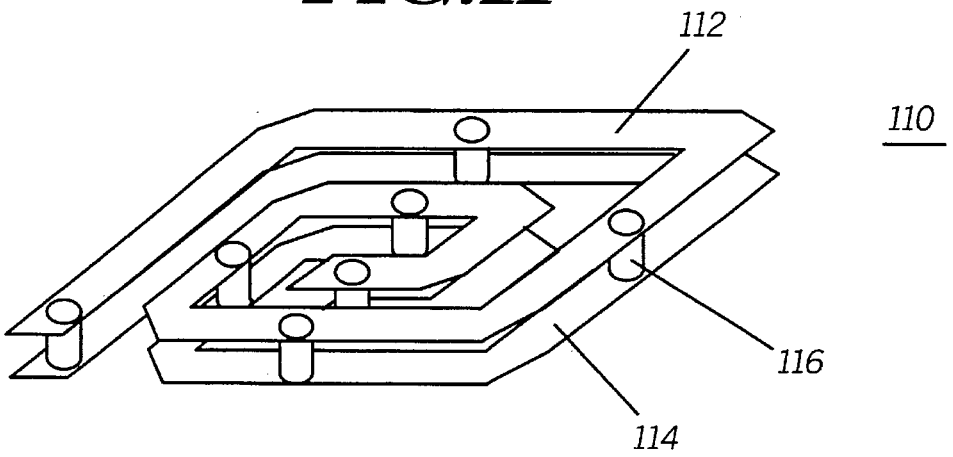

FIGS. 9, 10 and 11 are isometric views of alternative embodiments the present invention showing various shaped implementations. FIG. 9 depicts a meandered implementation 90. Similar to that of FIG. 5, this embodiment shows a first metal trace 92 and second metal trace 94 in a U-shape connected by a plurality of vias 96. Similarly, FIG. 10 shows a zig-zagged implementation 100 with first metal trace 102 and second metal trace 104 connected by vias 106. FIG. 11 shows a spiral implementation 110 with first trace 112, second trace 114 connected by vias 116 which is used for limited space applications.

Figure 12:
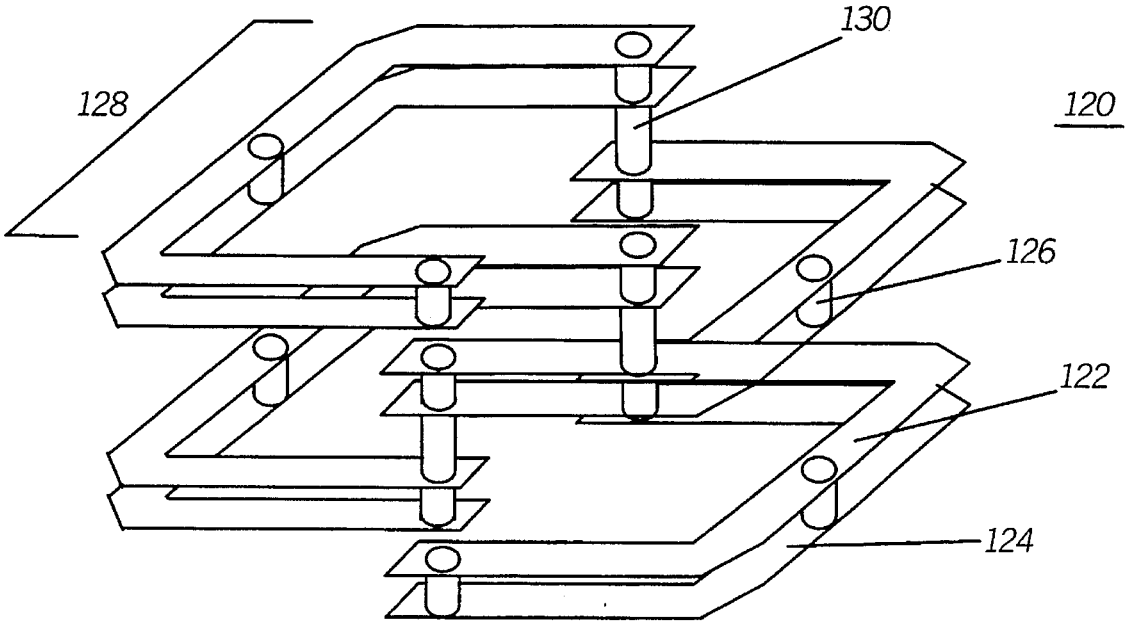
FIG. 12 illustrates a two turn conductor structure using double layered metalization techniques of the current invention.

Finally, FIG. 12 shows an isometric view of an alternative embodiment of the present invention using a two turn helical conductor structure. The helical implementation is shown generally at 120 and includes a first trace 122, second trace 124 each interconnected by vias 126. Each of the U-shaped sections 128 are attached through joining members or vias 130. The vias 130, as indicated herein, are spaced at ⅛th wavelength intervals of the operating frequency to facilitate propagation of the electromagnetic wave through those devices having a non-linear configuration.

It should be recognized by those skilled in the art that the application of various embodiments shown in FIGS. 9–12 do include a ceramic substrate (not shown) which separates and extends between the metal traces. Additionally, one or more conductive shields are positioned on the outside surfaces of the metal traces in order to provide shielding and/or isolation from extraneous electromagnetic energies and interference.

Moreover it will also be appreciated that the use of multiple layers connected by vias serving as an integrated RF signal path with reduced attenuation is not limited to resonator applications. The present invention may be applied to such RF components such as spiral inductors and helical inductors with a horizontal or vertical axis, as well as transmission lines in stripline form, transmission lines in basic microstrip form and a partially embedded stripline. Additionally, all devices which utilize transmission lines such as power splitters, coupler and impedance transformers may utilize the principles of the present invention as set forth above.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A high Q multi-layer ceramic radio frequency (RF) transmission line for carrying electromagnetic energy at an operating frequency comprising:

a first strip conductor attached to a first ceramic substrate for carrying RF energy;

a second strip conductor attached to a second ceramic substrate for carrying RF energy;

a third ceramic substrate positioned between the first strip conductor and the second strip conductor;

a plurality of vias interconnecting the first strip conductor and the second strip conductor at at least ⅛ wavelength intervals of the operating frequency through the third ceramic substrate; and at least one ground plane positioned about both an outer surface of the first ceramic substrate and an outer surface of the second ceramic substrate for shielding the first strip conductor and the second strip conductor from electromagnetic energy.

2. A high Q multi-layer ceramic RF transmission line as in claim 1 wherein the first strip conductor and the second strip conductor are separated by a predetermined distance.

3. A high Q multi-layer ceramic RF transmission line as in claim 1 wherein the first strip conductor and the second strip conductor are made of silver metal.

4. A high Q multi-layer ceramic RF transmission line as in claim 1 wherein the transmission line is configured into a substantially spiral shape.

5. A high Q multi-layer ceramic RF transmission line resonator as in claim 1 wherein the resonator is configured into a substantially helical shape.

6. A multi-layer radio frequency (RF) spiral transmission line for carrying electromagnetic energy at an operating frequency comprising:

a first strip conductor positioned into a spiral configuration;

a second strip conductor positioned into a spiral configuration;

at least one substrate positioned between the first strip conductor and the second strip conductor;

a plurality of vias for electrically interconnecting the first strip conductor and the second strip conductor positioned at at least ⅛ wavelength intervals of the operating frequency through the at least one substrate;

a first conductive shield and a second conductive shield positioned on an outside surface of the first strip conductor and the second strip conductor respectively for shielding the first strip conductor and the second strip conductor from interference; and wherein the first strip conductor is positioned over the second strip conductor forming a spiral resonator for use in applications with limited space.

7. A multi-layer RF transmission line as in claim 6 wherein the first conductive shield and the second conductive shield are made of a metal.

8. A multi-planar radio frequency (RF) transmission line helical resonator for carrying electromagnetic energy at an operating frequency comprising:

a plurality of substantially U-shaped first strip conductors;

a plurality of substantially U-shaped second strip conductors;

at least one ceramic substrate positioned between each of the plurality first strip conductors and the plurality of second strip conductors;

a plurality of vias for electrically interconnecting each of the plurality of first strip conductors and each of the plurality of second strip conductors that are positioned at at least ⅛ wavelength intervals of the operating frequency through the at least one ceramic substrate;

a first conductive shield and a second conductive shield positioned on an outside surface of each of the plurality of first strip conductors and each of the plurality of second strip conductor respectively for shielding the first strip conductor and the second strip conductor from interference; and wherein the plurality of substantially U-shaped first strip conductors and the plurality of substantially U-shaped second strip conductors and are interconnected into a substantially helical configuration to form helical resonator.

9. A multi-planar transmission line helical resonator as in claim 8 wherein the plurality of substantially U-shaped first strip conductors and the plurality of substantially U-shaped second strip conductor are separated by a predetermined distance.

* * * * *